US008397839B2

(12) United States Patent
Lyon

(10) Patent No.: US 8,397,839 B2
(45) Date of Patent: Mar. 19, 2013

(54) SELF-INDEXING DOWN-THE-HOLE DRILL

(75) Inventor: Leland H. Lyon, Roanoke, VA (US)

(73) Assignee: Center Rock Inc., Berlin, PA (US)

( * ) Notice: Subject to any disclaimer, the term of this patent is extended or adjusted under 35 U.S.C. 154(b) by 381 days.

(21) Appl. No.: 12/494,759

(22) Filed: Jun. 30, 2009

(65) Prior Publication Data

US 2009/0321143 A1 Dec. 31, 2009

Related U.S. Application Data

(60) Provisional application No. 61/076,876, filed on Jun. 30, 2008.

(51) Int. Cl.
*E21B 4/10* (2006.01)

(52) U.S. Cl. ..... 175/298; 175/306; 175/415

(58) Field of Classification Search ..... 175/298, 175/296, 321, 414, 415, 305, 306
See application file for complete search history.

(56) References Cited

U.S. PATENT DOCUMENTS

| | | | | |
|---|---|---|---|---|
| 3,299,971 | A * | 1/1967 | Lewis | 175/92 |
| 5,139,093 | A * | 8/1992 | Lyon et al. | 173/97 |
| 5,305,837 | A | 4/1994 | Johns et al. | |
| 5,322,136 | A | 6/1994 | Bui et al. | |
| 5,350,025 | A * | 9/1994 | Campbell et al. | 173/111 |
| 5,711,205 | A | 1/1998 | Wolfer et al. | |
| 5,735,358 | A | 4/1998 | Lyon | |
| 6,609,577 | B2 | 8/2003 | Beccu | |
| 2009/0200082 | A1 * | 8/2009 | Bui et al. | 175/61 |

* cited by examiner

*Primary Examiner* — William P Neuder
*Assistant Examiner* — Kipp Wallace
(74) *Attorney, Agent, or Firm* — Kim Krizman LLC

(57) ABSTRACT

A down-the-hole drill (DHD) hammer having a casing, a drill bit proximate a distal end of the casing, a piston mounted within the casing and a self-indexing drive transmission is provided. The piston includes a plurality of helical and axial splines. The drive transmission includes a driver sleeve, a driven sleeve and a wrap spring clutch assembly. The driver sleeve and driven sleeve are housed within the casing and circumscribes the piston. The driver sleeve includes a plurality of openings for receiving a plurality of bearings. The driver sleeve bearings are configured to operatively engage the helical splines on the piston. The wrap spring clutch assembly includes a wrap spring circumscribing the driver sleeve and driven sleeve. The driven sleeve operatively engages the drill bit to rotationally index the drill bit.

22 Claims, 6 Drawing Sheets

SELF-INDEXING DOWN-THE-HOLE DRILL

CROSS-REFERENCE TO RELATED APPLICATIONS

The present application claims priority to U.S. Provisional Patent Application No. 61/076,876, filed Jun. 30, 2008 and entitled "Self-Indexing Down-The-Hole Drill."

BACKGROUND OF THE INVENTION

The present invention generally relates to down-the-hole drills ("DHD"). In particular, the present invention relates to a self-indexing down-the-hole drill.

Typical DHDs involve a combination of percussive and rotational movement of the drill bit to drill or chip away at rock. Such DHDs are powered by a rotatable drill string attached to a drilling platform, that supplies rotation and high pressure gases (e.g., air) for percussive drilling. Moreover, in percussive drilling, rock cutting is a result of percussive impact forces rather than shear forces. In other words, rotation of the DHD merely serves to rotationally index the drill bit to fresh rock formations after the drill bit impacts a rock surface rather then to impart shear cutting forces to the rock surface.

Conventional DHDs therefore, do not adequately address the needs of all industry drilling requirements. For example, in the exploration of oil and gas, directional drilling is often required. Directional drilling is the drilling of non-vertical boreholes or wells. Directional drilling requires that the DHD, along with its drill string, not rotate so that the required bend, or slant, can be developed with a bent sub. The bent sub allows a DHD to be angled to create the bend needed for the slanted borehole and is typically housed within the drill string. Therefore, as directional drilling requires a DHD capable of rotation for drilling, but also to not rotate such that a slanted borehole can be developed, directional drilling precludes the use of conventional DHDs.

Various attempts have been made to address the need for percussive directional drilling. For example, attempts have been made to partially overcome the problem by coupling a conventional down-the-hole motor with a conventional DHD. However, conventional down-the-hole motors typically do not operate at the necessary torque and speed for directional drilling. In addition, the long lengths of conventional down-the-hole motors and DHD assemblies renders such devices more susceptible to fatigue stresses and failure. Others have also attempted to induce rotation of DHD assemblies with integral rotation devices. However, such devices developed to date are unreliable and prone to failure due to the complexity and number of components required for such devices and because such devices are highly sensitive to abusive drilling environments.

Thus, there is still a need for a DHD hammer that overcomes the problems of length, motor deficiencies and reliability issues associated with conventional DHDs for use in directional drilling.

BRIEF SUMMARY OF THE INVENTION

In accordance with a preferred embodiment, the present invention provides for a down-the-hole drill hammer comprising a generally cylindrical casing, a drill bit, a piston, a driver sleeve, a driven sleeve and a wrap spring. The drill bit is configured proximate to a distal end of the casing. The a piston mounted within the casing to reciprocally move within the casing along a longitudinal direction and includes a plurality of helical splines on a piston surface. The driver sleeve circumscribes the piston and includes a plurality of openings. The driven sleeve circumscribes the piston. The wrap spring circumscribes the driver sleeve and the driven sleeve. A plurality of bearings is configured within the plurality of openings of the driver sleeve to operatively engage the helical splines for rotationally indexing the drill bit.

In accordance with another preferred embodiment, the present invention provides for a down-the-hole drill hammer comprising a casing, a drill bit, a piston, a first sleeve, a second sleeve and a wrap spring. The drill bit is configured proximate to a distal end of the casing. The piston is configured within the casing to reciprocally move within the casing along an axial direction and includes at least one helical spline on a piston surface. The first sleeve circumscribes the piston and includes at least one helical spline mating with the at least one helical spline on the piston surface. The second sleeve circumscribes the piston. The first sleeve and the second sleeve form a clutch surface. The wrap spring operatively engaging the clutch surface.

BRIEF DESCRIPTION OF THE SEVERAL VIEWS OF THE DRAWINGS

The following detailed description of preferred embodiments of the present invention will be better understood when read in conjunction with the appended drawings. For the purposes of illustrating the invention, there are shown in the drawings embodiments which are presently preferred. It is understood, however, that the invention is not limited to the precise arrangements and instrumentalities shown. In the drawings.

DETAILED DESCRIPTION OF THE INVENTION

Reference will now be made in detail to the present embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. The term "distal" shall mean toward the bit-end. The term "proximal" shall mean toward the backhead-end. Such directional terms used in conjunction with the following description of the drawings should not be construed to limit the scope of the invention in any manner not explicitly set forth.

Figure 1:
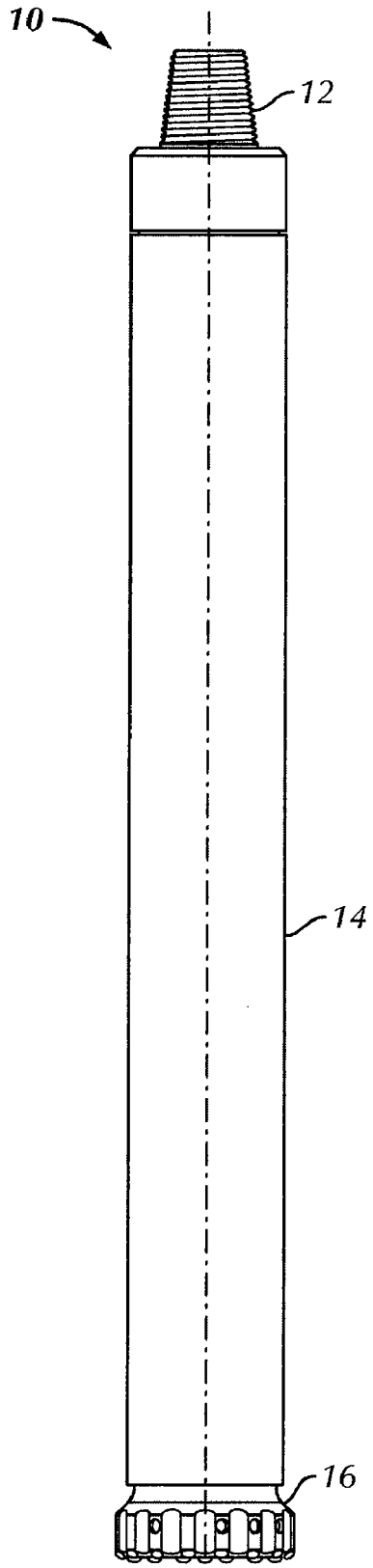
FIG. 1 is a side elevational view of a DHD hammer in accordance with a preferred embodiment of the present invention.
Figure 2:
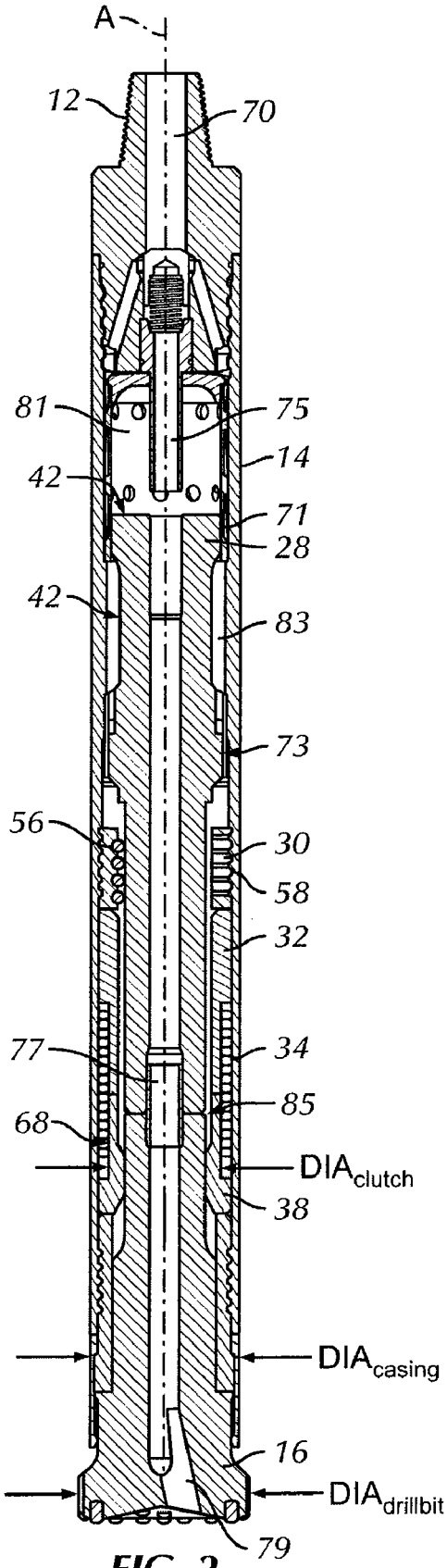
FIG. 2 is a side cross-sectional elevational view of the DHD hammer of FIG. 1.

In a preferred embodiment, the present invention provides for a self-indexing DHD hammer 10, as shown in FIGS. 1 and 2. The DHD hammer 10 includes a backhead 12, a casing 14 and a drill bit 16. The backhead 12 can be any conventional backhead 12 readily used in DHD hammers. The structure and operation of such backheads 12 is readily known in the art and a detailed description of them is not necessary for a complete understanding of the present invention. However, an exemplary backhead 12 suitable for use in the present embodiment is described in U.S. Pat. No. 5,711,205. The disclose of the backhead in U.S. Pat. No. 5,711,205 is hereby incorporated by reference.

The casing 14 has a generally cylindrical configuration to allow for the casing 14 to at least partially or completely house the backhead 12 and drill bit 16. The casing 14 also houses a piston 28 and a drive transmission, as further described below.

Figure 3:
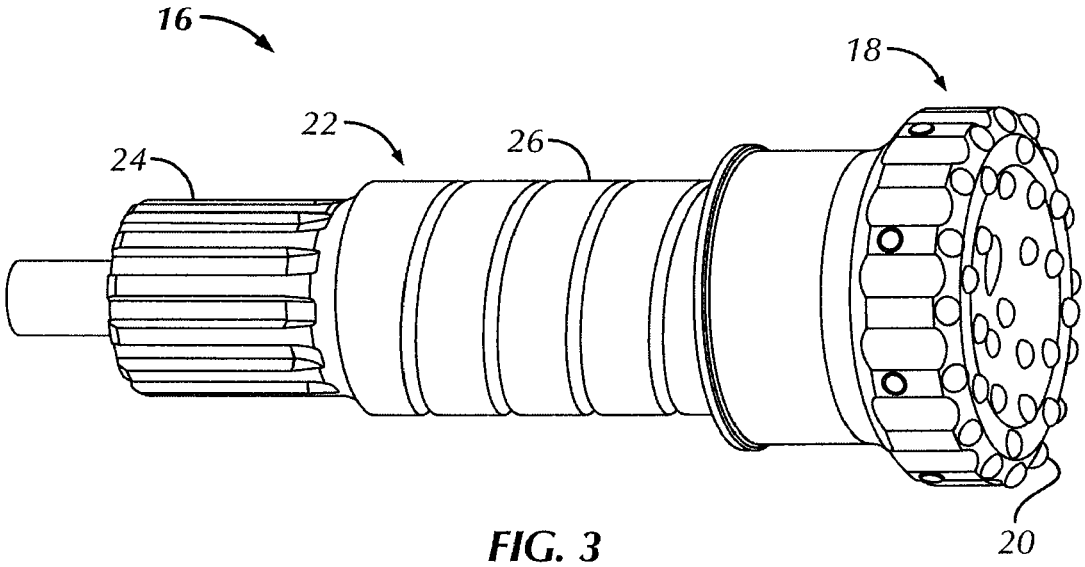
FIG. 3 is an enlarged perspective view of a drill bit of the DHD hammer of FIG. 1.
Figure 4:
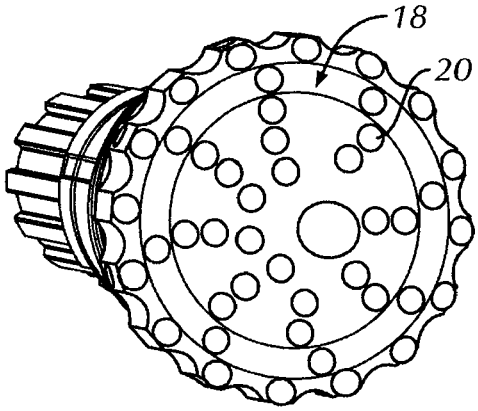
FIG. 4 is a front perspective view of the drill bit of FIG. 3.
Figure 5:
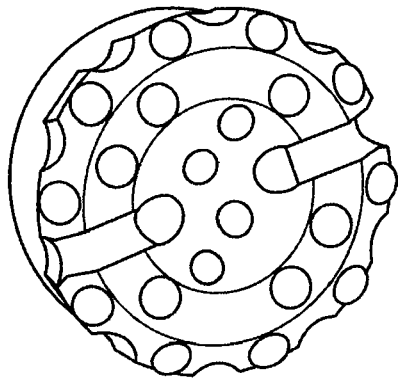
FIG. 5 (Prior Art)
FIG. 5 is a front perspective view of a conventional drill bit.

FIGS. 3 and 4 illustrate a preferred embodiment of the drill bit 16. The drill bit 16 is connected to the casing 14 proximate a distal end of the casing 14. The drill bit 16 is a single piece constructed part and is configured with a head 18 and a shank 22. The head 18 is generally configured similarly to conventional heads used in DHD hammers and includes a plurality of inserts 20 (also known as cutting inserts). As a rule of thumb, drill bits are typically operated with an index angle of about 70-100% of the insert diameter per impact. Thus, for a conventional 6½ inch diameter drill bit having ¾ inch diameter inserts operating at 1,800 cycles per minute, a DHD hammer would require an operating speed of 66 rpm. However, the dill bit 16 of the present invention is configured with inserts 20 having a diameter of about ½ inch. As a result, the DHD hammer 10 of the present invention only requires an operating speed of about 44 rpm to operate at about 1,800 cycles per minute. Additionally, due to the smaller diameter inserts 20, the drill bit 16 can be configured with a greater number of inserts 20 on the head 18 which results in less penetration per impact cycle yet greater rock face coverage and a reduction in torque necessary to index the DHD hammer 10 compared to conventional drill bits as shown, for example, in FIG. 5. Thus, the torque and rpm requirements necessary for operation of the DHD hammer 10 of the present invention are advantageously reduced.

Figure 6:
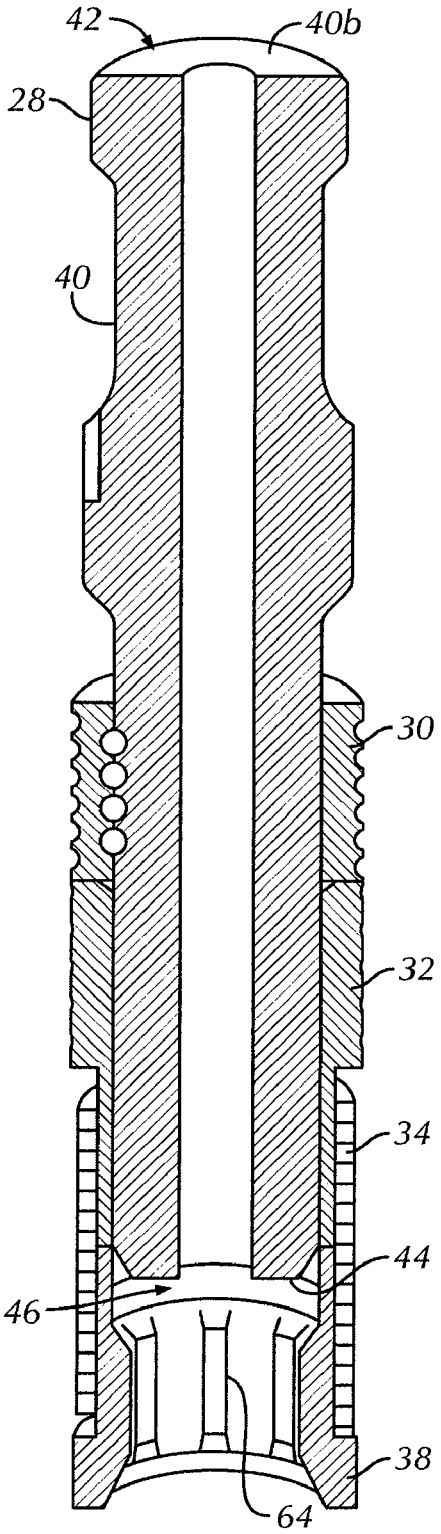
FIG. 6 is a perspective cross-sectional view of a piston and drive transmission of a DHD hammer in accordance with a preferred embodiment of the present invention.

The shank 22 of the drill bit 16 is configured with a plurality of radially spaced splines 24 at least at its proximal end having an outside diameter which at least slightly smaller then the body 26 of the shank 22. As shown in FIGS. 2 and 6, the splines 24 are configured to engage complimentary bit splines 64 of a driven sleeve 38.

Referring to FIGS. 2, 6, 7 and 9, the DHD hammer 10 includes the piston 28, a locking sleeve 30, a driver sleeve 32, a wrap spring 34 and the driven sleeve 38 all housed within the casing 14 (FIG. 2). The piston 28 is mounted within the casing 14 to move reciprocatively (up and down) within the casing 14 along a longitudinal direction. That is, the piston 28 is configured to move in the proximal and distal direction along a central axis A.

Figure 7:
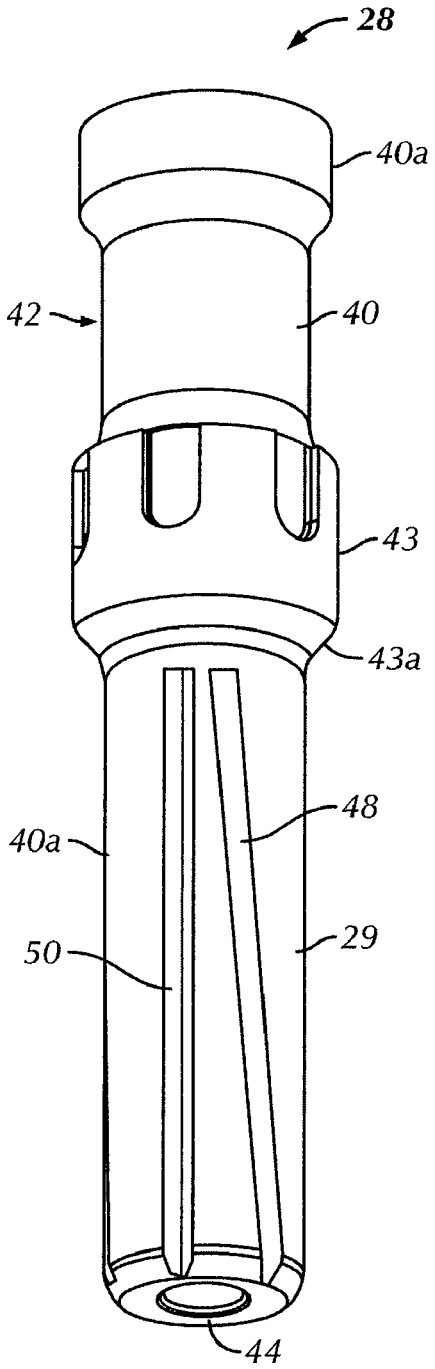
FIG. 7 is an enlarged perspective view of the piston of FIG. 6.

The piston 28 is generally configured as shown in FIGS. 6 and 7. About its proximal end, the piston 28 includes a smaller diameter section 40, a larger diameter section **40*a* and a drive surface 40*b*. The area generally encompassing the smaller diameter section 40, the larger diameter section 40*a*, and the drive surface 40*b* comprise a piston drive area 42. The drive surface 40*b* in combination with the inner wall of the casing 14 generally comprise a driver chamber 81 while the larger diameter section 40*a* and the smaller diameter section 40 in combination with the inner wall of the casing 14 generally comprise a reservoir 83. The area generally encompassing the distal end face 44, the outer surface 29 and a distal edge 43*a* of a larger diameter section 43 of the piston 28 comprise a piston return area 46 (FIG. 6). The piston return area 46 in combination with the inner wall of the casing 14 generally comprise a return chamber 85. By alternating between high (supply) and low (exhaust) pressures within the piston drive area 42 and piston return area 46, the piston 28 is cycled axially e.g., about four (4) inches per cycle at about 1,600 cycles/minute to induce percussive forces on the drill bit 16. The alternating high and low pressure is cycled through the DHD hammer 10 through conventional porting within the DHD hammer 10**. Such porting of DHD hammers are known in the art and a detailed description of them is not necessary for a complete understanding of the present embodiment.

However, as shown in FIG. 2, such porting systems can include a central port 70, blow ports 71 (171 in FIG. 10), a lower piston seal path 73, an exhaust valve stem 75, an exhaust tube 77 and a central bit flushing port 79. The porting system as shown provides a fluid passageway which allows for supply flow to compress and exhaust working air pressures within the drive chamber 81, reservoir 83 and return chamber 85 to reciprocally drive the piston 28 within the casing 14.

Figure 9:
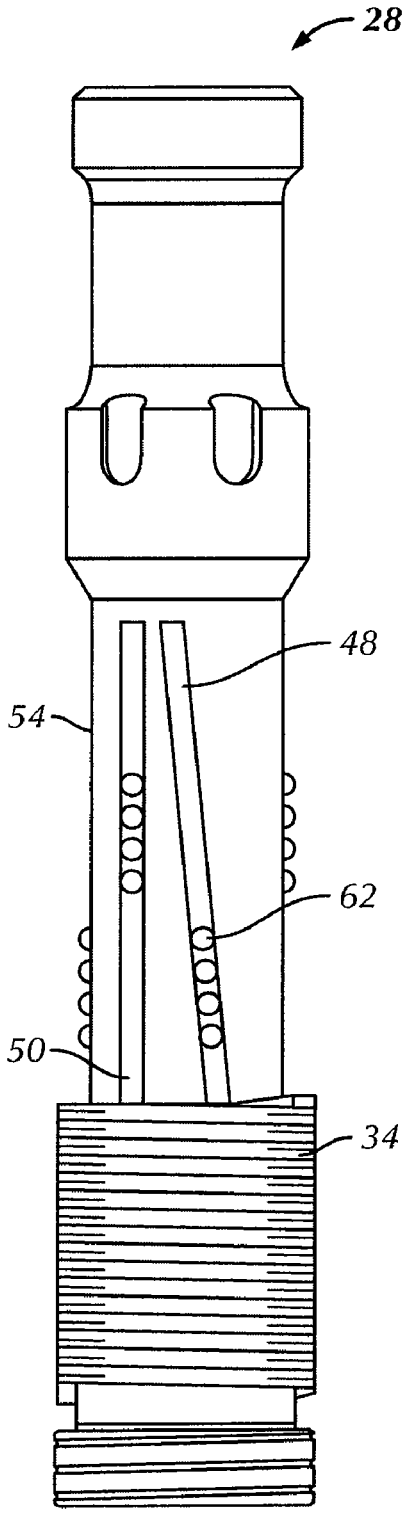
FIG. 9 is a side elevational view of the piston and drive transmission of FIG. 6 without a locking sleeve and a driver sleeve.

About its distal end, the piston 28 includes a smaller diameter section **40*a* that includes a plurality of helical splines 48 and straight axial splines 50 circumferentially spaced apart about its outer surface 29, as best shown in FIGS. 7 and 9. The plurality of helical and straight axial splines 48, 50 are preferably configured as female splines. The straight splines 50 run generally parallel with a central axis of the piston 28. The helical splines 48 are configured to run in a generally helical fashion, such that upon movement of the piston 28 in the distal direction, the helical splines 48 function to rotate the driver sleeve 32, as further described in detail below. Preferably, the piston 28 is configured with three straight splines 50 and three helical splines 48. More preferably, the distal ends of the straight splines 50 and helical splines 48 are configured to be generally evenly circumferentially spaced apart. However, other arrangements and spacing of the straight splines 50 and/or the helical splines 48** may be used.

Figure 8:
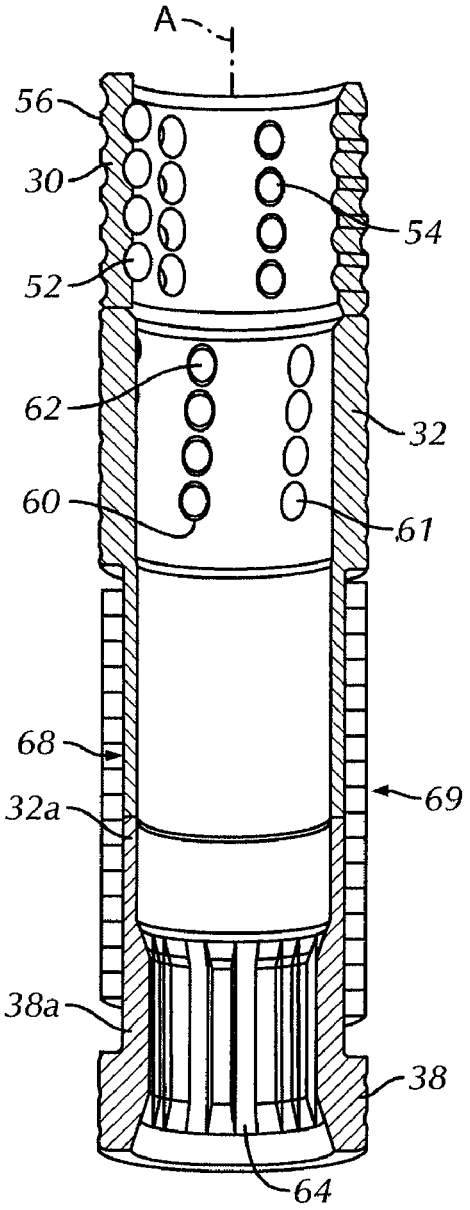
FIG. 8 is an enlarged perspective cross-sectional view of the drive transmission of FIG. 6.

Referring to FIGS. 2, 6 and 8, the locking sleeve 30 is generally cylindrical in shape and configured to circumscribe the piston 28. The locking sleeve 30 is proximal to the driver sleeve 32 and configured with right-handed threads 56 about its outside surface. The threads 56 when assembled to form the DHD hammer 10, engage mating threads 58 configured along the inner wall of the casing 14 (as best shown in FIG. 2) to secure the locking sleeve 30 in a fixed position relative to the casing 14. The threads 56, 58, being right-handed threads, function to tighten upon the rotational indexing of the drill bit 16 counter to the thread direction of threads 56, 58.

Figure 8A:
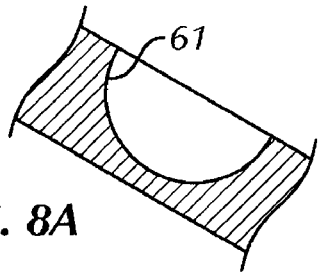
FIG. 8A is a fragmentary, cross-sectional, elevational view of a bearing pocket of the drive transmission of FIG. 8.

The locking sleeve 30 further includes a plurality of locking sleeve openings 52 arranged in a columnar fashion and configured to receive a plurality of bearings, such as ball bearings 54. The openings 52 serve as bearing pockets configured to receive the ball bearing 54. Preferably, the openings 52 are configured as a semi-spherical pocket 61 with a through hole passage 63 having an overall width smaller in diameter than the semi-spherical pocket 61 width (FIG. 8A). The locking sleeve 30 is preferably configured with four such openings 52 per column and three columns per locking sleeve 30. The plurality of columns are spatially configured to align with the plurality of straight splines 50 on the piston 28. The ball bearings 54 when seated within the openings 52 of the locking sleeve 30 operatively engage the axial splines 50 thereby preventing the piston 28 from rotation with respect to the locking sleeve 30 and casing 14. As a result, the piston 28 is a non-rotating piston 28 that reciprocally moves only in the axial direction within the casing 14. In operation, the locking sleeve 30 is locked in a fixed position within the casing 14 and advantageously transmits torque reaction forces onto the casing 14.

Referring to FIGS. 2, 6 and 8, the driver sleeve 32 is generally cylindrical in shape and configured to circumscribe the piston 28. The driver sleeve 32 includes a proximal end having a plurality of openings 60 and a driver sleeve drum portion 32*a* about its distal end. The drum portion 32*a* includes an overall diameter that is smaller than the overall diameter of the proximal end of the driver sleeve 32. The openings 60 serve as bearing pockets configured to receive a plurality of bearing, such as ball bearings 62, as further described below. The openings 60 are arranged in a helical columnar fashion about the proximal end of the driver sleeve 32. Preferably, the driver sleeve 32 is configured with the largest possible outside and inside diameter such that the piston 28 and drill bit 16 can be sized as large as possible. The diameter of the driver sleeve 32 is primarily limited by the size of the casing 14.

Each of the plurality of driver sleeve openings 60 is configured to receive a ball bearing 62. Preferably, the openings 60 are each configured as a semi-spherical pocket 61, as best shown in FIG. 8A. The driver sleeve 32 is configured with four openings 60 per helical column and three helical columns per driver sleeve 32. The plurality of openings 60 of the helical columns are spatially configured to align with the plurality of helical splines 48 on the piston 28. Thus, the ball bearings 62 when seated within the openings 60 operatively engage the helical splines 48 to rotationally index the drill bit 16. In operation, as the piston 28 is percussively driven, the driver sleeve 32 oscillates rotationally back and forth as the helical splines 48 engages and disengages the wrap spring 34, as further discussed below.

Preferably, the ball bearings 54, 62 are ½ inch diameter ball bearings. However, it is within the intent and scope of the present embodiment that the ball bearings 54, 62 can be any size suitable for their intended use. For example, the size of the ball bearings 54, 62 may depend upon the size of the DHD hammer 10 and the load and torque requirements of the DHD hammer 10. The bearing pockets 52, 60, straight splines 50, and helical splines 48 are preferably configured in a gothic arch shape. The bearing pockets 52, 60 are preferably formed by drilling the bearing pockets 52, 60 from the outside in. That is, the bearing pockets 52, 60 are formed by initially drilling through holes in the locking sleeve 30 or driver sleeve 32, and then drilling the bearing pockets 52, 60 along an opposite wall of the locking sleeve 30 or driver sleeve 32 to the necessary depths. However, it is within the intent and scope of the present embodiment that the bearing pockets 52, 60 can be manufactured by any other conventional method known in the art or to be developed and that the shape of the bearing pockets 52, 60 and splines 50, 48 may be any other shape suitable for the intended use.

Referring to FIGS. 2, 6 and 8, the driven sleeve 38 is generally cylindrical in shape and configured to circumscribe the piston 28. The driven sleeve 38 includes a distal end, a driven sleeve drum portion 38*a* proximal to the distal end, and a plurality of bit splines 64 configured along the inner surface of the driven sleeve's distal end. The drum portion 38*a* includes an overall diameter smaller than that of the distal end. The driven sleeve 38 is configured with the largest outside and inside diameter possible such that the proximal end of the drill bit 16 with splines 24 can be sized as large as possible. The size of the diameter of the driven sleeve 38 is primarily limited by the size of the casing 14. The driven sleeve 38 is also sized such that the outside diameter of the driven sleeve drum portion 38*a* is slighter larger than the inside diameter of the wrap spring 34 and slightly smaller than the outside diameter of the driver sleeve drum portion 32*a*. The driven sleeve 38 is assembled within the casing 14 such that the driven sleeve bit splines 64 operatively engage the splines 24 of the drill bit 16, as best shown in FIG. 2, and is positioned distal to the driver sleeve 32

Referring to FIGS. 2 and 8, the wrap spring 34 is configured to circumscribe the distal drum portion 32*a* of the driver sleeve 32 and the proximal drum portion 38*a* of the driven sleeve 38. In particular, the driver sleeve drum portion 32*a* and driven sleeve drum portion 38*a* together form a clutch surface 68 about which the wrap spring 34 spans, thereby forming a wrap spring clutch assembly 69. As best shown in FIG. 2, the clutch surface 68 is sized to have the largest possible outside diameter within the casing 14. The size of the clutch surface 68 being primarily limited by the size of the casing 14 and thickness of the wrap spring 34. Maintaining the clutch surface 68 as large as possible allows for the transmission of the largest possible torque upon the driven sleeve 38 for driving the drill bit 16 and a more reliable and durable clutch. Preferably, the clutch surface 68 is sized to have an outside diameter ($DIA_{clutch}$) that is about 45-75% of the overall drill bit diameter ($DIA_{drill\ bit}$) or about 55-85% of the outside casing diameter ($DIA_{casing}$).

The wrap spring 34 is wrapped around the clutch surface 68 in a left-handed direction so that as a right-handed rotation of the wrap spring 34 is applied across the clutch surface 68, the wrap spring 34 tightens up and grips the clutch surface 68 to apply a torque. Conversely, the clutch surface 68 slips, or overrides, when a left-handed torque is applied to the wrap spring 34. The wrap spring 34 is sized such that the inside diameter of the wrap spring 34 is slightly smaller than the outside diameter of both the driver sleeve drum portion 32*a* and driven sleeve drum portion 38*a*. As a result of the undersizing of the wrap spring 34 inside diameter, the wrap spring 34 has an interference engagement with both the driver sleeve drum portion 32*a* and the driven sleeve drum portion 38*a* so as to frictionally engage both drum portions 32*a*, 38*a*. The interference engagement between the wrap spring 34 and driver sleeve drum portion 32*a* is greater than that of the interference engagement between the wrap spring 34 and the driven sleeve drum portion 38*a*. This can be accomplished by appropriate sizing of the drum portions 32*a* and 38*a*, for example, by configuring the outside diameter of drum portion 32*a* to be slightly greater than the outside diameter of drum portion 38*a*. In sum, the wrap spring 34 is configured to rotate the driven sleeve 38 and essentially drive the rotation of the driven sleeve 38, which thereby drives rotation of the dill bit 16. In addition, once the drill bit 16 is rotating during use, additional torque is only transmitted when the rotational speed of the driver sleeve 32 exceeds that of the wrap spring 34.

In operation, the piston 28 of the DHD hammer 10 of the present embodiment is percussively driven as a result of alternating high and low pressure gas entering and existing the casing 14. High pressure gas initially enters the DHD hammer 10 through the backhead 12 and passes down the central port 70. The high pressure gas enters the piston drive area 42 and piston return area 46 through conventional porting to percussively drive the piston 28. As a result of the configuration of the locking sleeve 30, driver sleeve 32 and straight and helical splines 50, 48, when the piston 28 is percussively driven, the driver sleeve 32 oscillates rotationally about the central axis A. The degree of rotation of the driver sleeve 32 is defined by the circumferential distance of the proximal end of the helical splines 48 relative to its distal end. As the piston 28 is driven distally, the piston 28 rotates the driver sleeve 32 in a clockwise direction and in the counter-clockwise direction when the piston 28 is driven proximally. The rotation of the driver sleeve 32 engages the wrap spring 34 causing it to rotate as a result of the interference engagement between the driver sleeve drum portion 32*a* and the wrap spring 34. As the wrap spring 34 rotates and tightens up, it engages the driven sleeve 38 causing the driven sleeve 38 to then rotate.

The present invention advantageously provides for a DHD hammer 10 that rotationally self-indexes the drill bit 16 independent of a drill string. As such, the DHD hammer 10 of the present invention can be used for directional drilling without the need for any additional motors or other devices to drive rotation of the DHD hammer 10. In addition, the DHD hammer 10 advantageously provides for rotation of the drill bit 16 upon the impact stroke of the piston 28 as opposed to the return stroke of the piston 28, as indexing on the return stroke can increase the torque requirements necessary for rotational indexing. The increased torque requirement upon the return stroke results from reaction forces on the DHD hammer 10 forcing the casing 14 distally and against the drill bit 16. Moreover, because of the relatively large diameter clutch surface 68 compared to the casing 14 diameter, the present invention provides for higher torque forces and improved durability of the overall DHD hammer 10 by allowing for larger sized drill bit shanks. Plus, as the piston 28 is decoupled from the drill bit 16, the DHD hammer 10 provides for a more robust design with less internal stresses compared to conventional DHD hammers in which the piston and drill bit are coupled or partially coupled.

In another preferred embodiment, the present invention provides for a down-the-hole drill hammer 100, as shown in FIGS. 10-13. The DHD hammer 100 is configured substantially the same as for the above embodied DHD drill hammer 10 except for the locking sleeve 130, driver sleeve 132, driven sleeve 138 and wrap spring 134.

Figure 10:
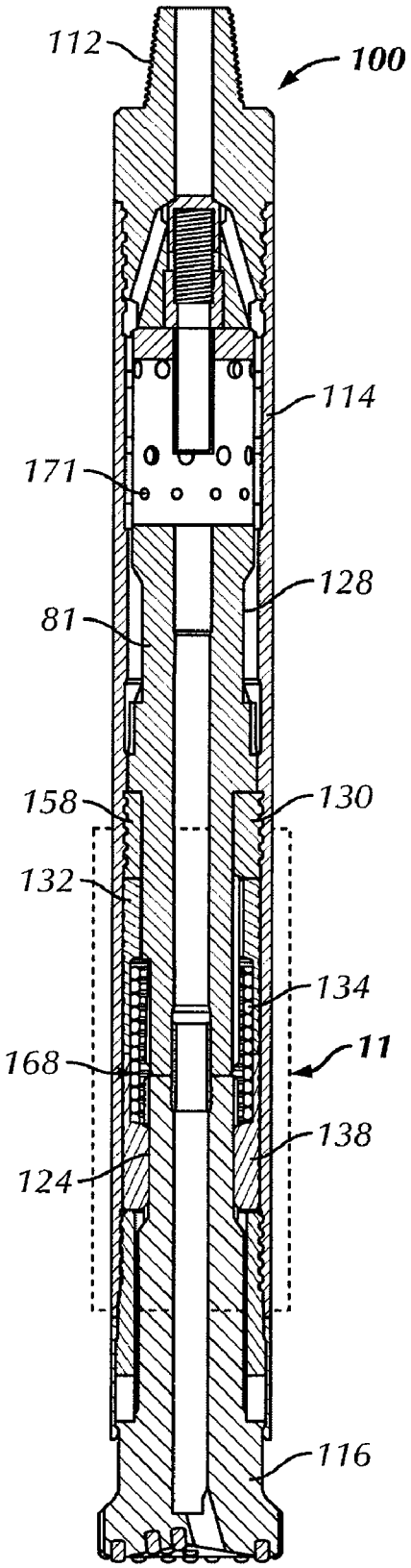
FIG. 10 is a side cross-sectional elevational view of a DHD hammer in accordance with another preferred embodiment of the present invention.

Referring to FIG. 10, the DHD hammer 100 includes a casing 114, a piston 128, a first or driven sleeve 132, a second or driven sleeve 138, a third or locking sleeve 130, a wrap spring 134 and a drill bit 116. The piston 128 (FIG. 13) is similar to piston 28 and includes a proximal end 141 and distal end 143. The distal end 143 includes at least one helical spline 148 and at least one straight axial spline 150 on its outer surface 129. Similar to piston 28, the piston 128 is configured within casing 114 to move reciprocatively therein along an axial direction. Preferably, the at least one helical spline 148 and the at least one axial spline 150 are female splines.

Figure 12:
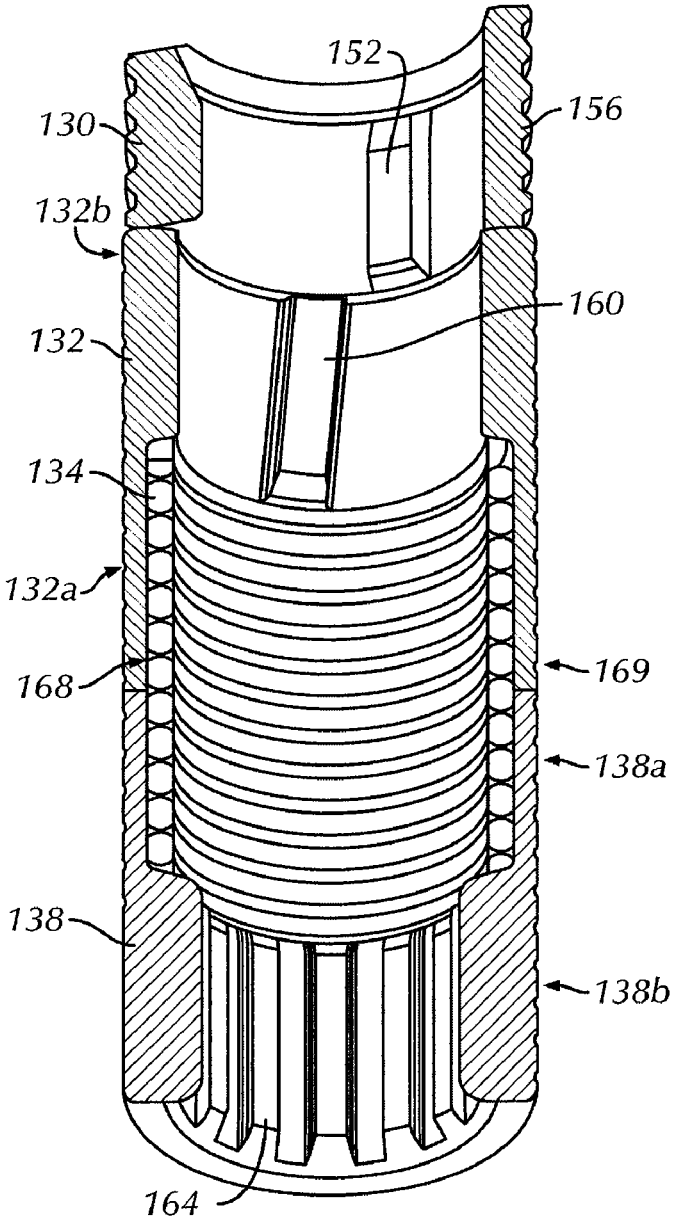
FIG. 12 is an enlarged cross-sectional perspective view of the drive transmission of FIG. 11 without a piston or drill bit.
Figure 13:
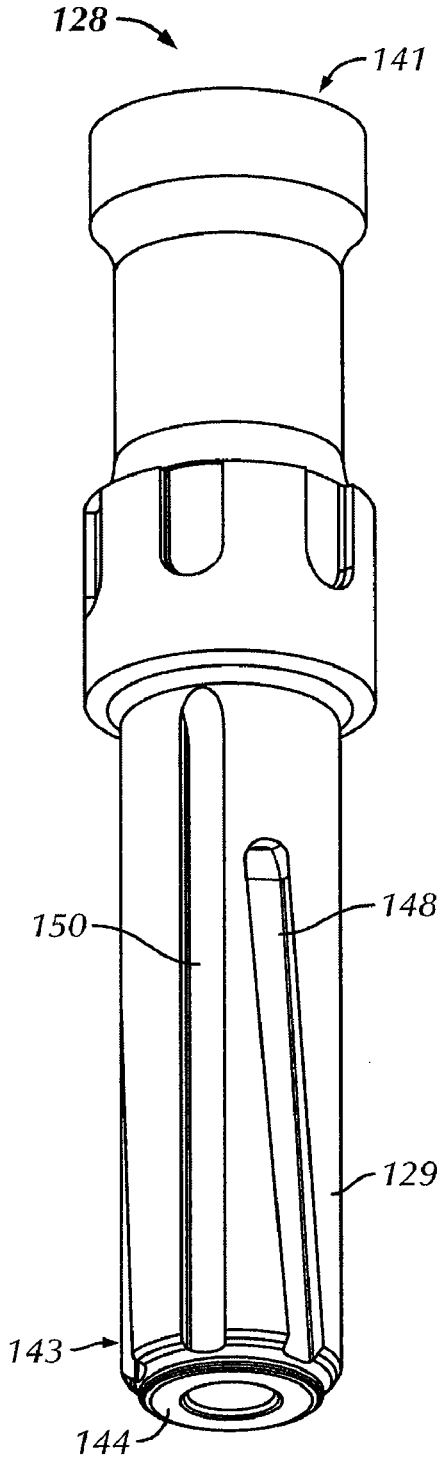
FIG. 13 is a perspective view of a piston of the DHD hammer of FIG. 10.

The third sleeve 130 is similar to locking sleeve 30. Referring to FIGS. 10 and 12, the third sleeve 130 is generally cylindrical in shape and configured to circumscribe a portion of the piston 128. The third sleeve 130 is also configured with right-handed threads 156 about its outside surface. The threads 156 when assembled to the DHD hammer 100, engage mating threads 158 configured along the inner wall of the casing 114 to secure the third sleeve 130 in a fixed position relative to the casing 114.

The third sleeve 130 includes at least one axial spline 152. The axial spline 152 is configured to mate with a corresponding spline on the piston 128 and is further oriented so as to extend in the axial or longitudinal direction. Preferably, the third sleeve 130 includes three axial splines 152 configured as male splines. When configured with more than one axial spline 152, the axial splines 152 are preferably equally circumferentially spaced apart.

The at least one axial spline 152 of the third sleeve 130 is spatially configured to align with the at least one axial spline 150 on the piston 128. Preferably, the at least one axial spline 152 of the third sleeve 130 is a male spline for mating with the at least one axial spline 150 on the piston surface 129 configured as a female spline. The axial spline 152 of the third sleeve 130 operatively engages the axial spline 150 of the piston 128 thereby preventing the piston 128 from rotation with respect to the third sleeve 130 and casing 114. As a result, the piston 128 is a non-rotating piston 128 that reciprocally moves only in the axial direction within the casing 114. In operation, the third sleeve 130 is locked in a fixed position within the casing 114 thereby transferring torque reaction forces onto the casing 114.

The first sleeve 132 is similar to the driver sleeve 32. Thus, the first sleeve 132 is generally cylindrical in shape and configured to circumscribe the piston 128. The first sleeve 132 includes a proximal end 132*b* and a first sleeve drum portion 132*a* at the distal end. The proximal end 132*b* includes at least one helical spline 160. The helical spline 160 is configured to mate with a corresponding helical spline 148 on the piston 128 and is further oriented so as to extend in a helical direction. Preferably, the first sleeve 132 includes three helical splines 160 configured as male splines for mating with three helical splines 148 on the piston surface 129 configured as female splines. When configured with more than one helical spline 160, the helical splines 160 are preferably equally circumferentially spaced apart.

The outside diameter of the first sleeve drum portion 132*a* is equivalent to that of the proximal end 132*b*. The inside diameter of the first sleeve drum portion 132*a* is greater than the inside diameter of the proximal end 132*b*. The difference between the inside diameters of the proximal end 132*b* and first sleeve drum portion 132*a* is configured to allow for the wrap spring 134 to engage the inside surface of the first sleeve drum portion 132*a* without interfering with the percussive movement of piston 128. Preferably, the first sleeve 132 is configured with the largest possible outside and inside diameter such that the piston 128 and drill bit 116 can be sized as large as possible. The overall diameter of the first sleeve 132 is primarily limited by the size of the casing 114.

In operation, as the piston 128 is percussively driven within the casing 114, the first sleeve 132 oscillates rotationally back and forth about the axis A as the helical splines 160 of the third sleeve 130 travel along the helical splines 148 of the piston 128.

The second sleeve 138 is similar to the driven sleeve 38. Thus, the second sleeve 138 is generally cylindrical in shape and configured to circumscribe the piston 128. The second sleeve 138 includes a proximal second sleeve drum portion 138*a* and a distal end 138*b* that is distal to the second sleeve drum portion 138*a*. The distal end 138 includes a plurality of circumferentially spaced bit splines 164 that engage splines 124 on the drill bit 116.

The outside diameter of the second sleeve drum portion 138*a* is equivalent to that of the distal end 138*b*. The inside diameter of the second sleeve drum portion 138*a* is greater than the inside diameter of the distal end 138*b*. The difference between the inside diameters of the distal end 138*b* and second sleeve drum portion 138*a* is configured to allow for the wrap spring 134 to engage the inside surface of the second sleeve drum portion 138*a* without interfering with the percussive movement of piston 128. Preferably, the second sleeve 138 is configured with the largest possible outside and inside diameter such that the piston 128 and drill bit 116 can be sized as large as possible. The overall diameter of the second sleeve 138 is primarily limited by the size of the casing 114.

Figure 11:
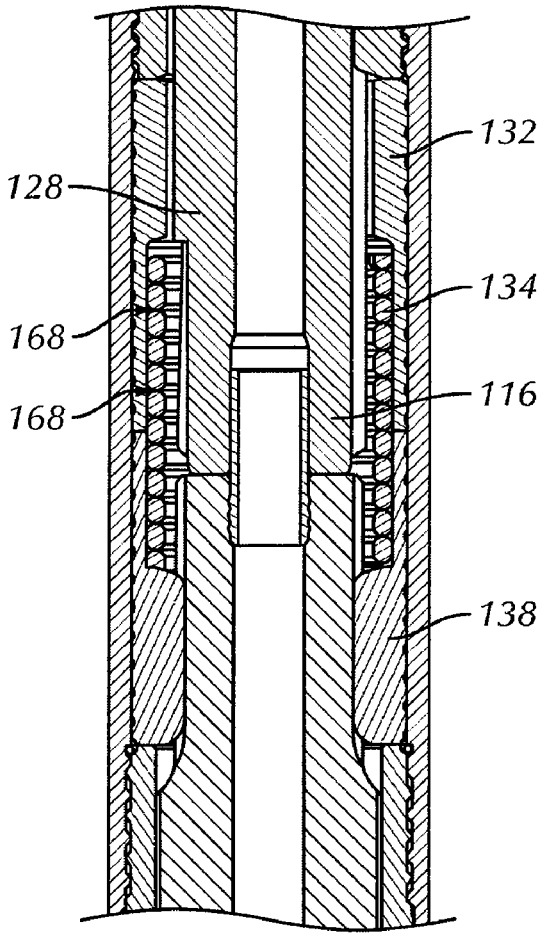
FIG. 11 is an enlarged side cross-sectional elevational view of a drive transmission of the DHD hammer of FIG. 10.

Referring to FIGS. 11 and 12, the wrap spring 134 is configured to inscribe the first sleeve 132 and second sleeve 138. In particular, the first sleeve drum portion 132*a* and second sleeve drum portion 138*a* together form a clutch surface 168 about which the wrap spring 134 inscribes and engages, thereby forming a wrap spring clutch assembly 169. As best shown in FIG. 12, the clutch surface 168 is sized to have the largest possible inside diameter within the casing 114. The overall diameter of the clutch surface 168 being primarily limited by the size of the casing 114 and thickness of the wrap spring 134. Maintaining the clutch surface 168 as large as possible allows for the transmission of the largest possible torque upon the second sleeve 138 for driving the drill bit 116 and a more reliable and durable clutch. Preferably, the clutch surface 68 is sized to have an outside diameter ($DIA_{clutch}$) that is about 53-83% of the overall drill bit diameter ($DIA_{drill\ bit}$) or about 62-92% of the outside casing diameter ($DIA_{casing}$).

The wrap spring 134 engages the clutch surface 168 formed by the inside surfaces of the first and second sleeve drum portions 132*a*, 138*a*. The wrap spring 134 frictionally engages the clutch surface 168 in a left-handed direction so that as a left-handed rotation of the wrap spring 134 is applied across the clutch surface 168, the wrap spring 134 expands to further engage the clutch surface 168 to apply a torque. Conversely, the clutch surface 168 slips, or overrides, when a right-handed torque is applied to the wrap spring 134. The wrap spring 134 is sized such that the outside diameter of the wrap spring 134 is slightly larger than the inside diameter of both the first sleeve drum portion 132*a* and second sleeve drum portion 138*a*. As a result of the oversizing of the wrap spring 134 outside diameter, the wrap spring 134 has an interference engagement with both the first sleeve drum portion 132*a* and the second sleeve drum portion 138*a*. The interference engagement between the wrap spring 134 and the first sleeve drum portion 132*a* is greater than that of the interference engagement between the wrap spring 134 and the second sleeve drum portion 138*a*. This can be accomplished by appropriate sizing of the drum portions 132*a* and 138*a*, for example, by configuring the inside diameter of drum portion 132*a* to be slightly smaller than the inside diameter of drum portion 138*a*. In sum, the wrap spring 134 is configured to rotate with the first sleeve 132 and essentially drives the rotation of the second sleeve 138, which thereby drives rotation of the dill bit 116. In addition, once the drill bit 116 is rotating during use, additional torque is only transmitted when the rotational speed of the first sleeve 132 exceeds that of the wrap spring 134.

It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the claims.

I claim:

1. A down-the-hole drill hammer comprising:

a casing;

a drill bit proximate to a distal end of the casing;

a piston configured within the casing to reciprocally move within the casing along an axial direction, the piston including at least one helical spline on a piston surface;

a first sleeve circumscribing the piston, the first sleeve including at least one helical spline mating with the at least one helical spline on the piston surface;

a second sleeve circumscribing the piston, the second sleeve having a plurality of splines engaging corresponding splines on the drill bit, the first sleeve and the second sleeve forming a clutch surface;

a third sleeve circumscribing the piston, and a wrap spring that operatively engages the clutch surface, wherein the first, second and third sleeves are housed within the casing and have substantially the same outside diameter.

2. The down-the-hole drill hammer of claim 1, wherein the third sleeve includes at least one axial spline mating with at least one axial spline on the piston surface.

3. The down-the-hole drill hammer of claim 2, wherein the at least one axial spline and the at least one helical spline on the piston surface are female splines and wherein the at least one axial spline on the third sleeve and the at least one helical spline on the first sleeve are male splines for operatively engaging the female splines on the piston surface.

4. The down-the-hole drill hammer of claim 1, wherein the wrap spring frictionally engages the first sleeve and the second sleeve upon rotation of the first sleeve.

5. The down-the-hole drill hammer of claim 1, wherein the piston is configured to reciprocally move only in the axial direction.

6. The down-the-hole drill hammer of claim 1, wherein the clutch surface circumscribes the wrap spring.

7. The down-the-hole drill hammer of claim 1, wherein the first sleeve has a first recess for receiving the wrap spring and the second sleeve has a second recess for receiving the wrap spring.

8. The down-the-hole drill hammer of claim 1, wherein the first sleeve includes a proximal end having an inside diameter and a distal end having an inside diameter greater than the inside diameter of the proximal end.

9. The down-the-hole drill hammer of claim 1, wherein the at least one helical spline of the first sleeve is positioned above the wrap spring and the plurality of splines of the second sleeve are positioned below the wrap spring.

10. The down-the-hole drill hammer of claim 1, wherein the first, second and third sleeves are sized to have a largest possible outside diameter limited only by the size of the casing.

11. The down-the-hole drill hammer of claim 1, wherein the first sleeve threadedly engages the casing.

12. The down-the-hole drill hammer of claim 1, wherein the first, second and third sleeves are axially aligned by the casing.

13. A down-the-hole drill hammer comprising:

a casing;

a drill bit proximate to a distal end of the casing;

a piston configured within the casing to reciprocally move within the casing along an axial direction, the piston including at least one helical spline on a piston surface;

a first sleeve circumscribing the piston, the first sleeve including at least one helical spline mating with the at least one helical spline on the piston surface;

a second sleeve circumscribing the piston, the first sleeve and the second sleeve forming a clutch surface;

a third sleeve circumscribing the piston, wherein the first, second and third sleeves have substantially the same outside diameter, and a wrap spring that operatively engages the clutch surface.

14. The down-the-hole drill hammer of claim 13, wherein the third sleeve includes at least one axial spline mating with at least one axial spline on the piston surface.

15. The down-the-hole drill hammer of claim 13, wherein the clutch surface circumscribes the wrap spring.

16. The down-the-hole drill hammer of claim 13, wherein the first sleeve includes a proximal end having an inside diameter and a distal end having an inside diameter greater than the inside diameter of the proximal end.

17. The down-the-hole drill hammer of claim 13, wherein the first, second and third sleeves are sized to have a largest possible outside diameter limited only by the size of the casing.

18. The down-the-hole drill hammer of claim 13, wherein the first, second and third sleeves are axially aligned by the casing.

19. A down-the-hole drill hammer comprising:

a casing;

a drill bit proximate to a distal end of the casing;

a piston within the casing to reciprocally move within the casing along an axial direction, the piston including a helical spline on a piston surface;

a first sleeve circumscribing the piston, the first sleeve including a helical spline mating with the helical spline on the piston surface;

a second sleeve circumscribing the piston, the second sleeve having a plurality of splines, the first sleeve and the second sleeve forming a clutch surface;

a third sleeve circumscribing the piston, wherein the first and third sleeves have substantially the same outside diameter, and a wrap spring that operatively engages the clutch surface.

20. The down-the-hole drill hammer of claim 19, wherein the first and third sleeves are axially aligned by the casing.

21. The down-the-hole drill hammer of claim 19, wherein the first, second and third sleeves are sized to have a largest possible outside diameter limited only by the size of the casing.

22. The down-the-hole drill hammer of claim 19, wherein the at least one helical spline of the first sleeve is positioned above the wrap spring and the plurality of splines of the second sleeve are positioned below the wrap spring.

* * * * *